US005538038A

United States Patent [19]

Boytim et al.

[11] Patent Number: 5,538,038

[45] Date of Patent: Jul. 23, 1996

[54] VACUUM RELIEF FITTING FOR SANITARY SILOS

[76] Inventors: Mark Boytim, 1248 Countryside La., Manteca, Calif. 95337; Eric G. Snoke, 705 E. Union Ave., Modesto, Calif. 95356

[21] Appl. No.: 142,450

[22] PCT Filed: Jun. 25, 1991

[86] PCT No.: PCT/US91/04527

§ 371 Date: Nov. 22, 1993

§ 102(e) Date: Nov. 22, 1993

[87] PCT Pub. No.: WO93/00537

PCT Pub. Date: Jan. 7, 1993

[51] Int. Cl.[6] ..... F16K 24/00

[52] U.S. Cl. ..... 137/585; 52/192; 285/154

[58] Field of Search ..... 4/211; 52/192; 137/143, 216, 585, 587; 285/153, 154, 155

[56] References Cited

U.S. PATENT DOCUMENTS

| | | | |
|---|---|---|---|
| 770,539 | 9/1904 | Ryan | 4/211 |
| 788,803 | 5/1905 | Walker | 285/154 |
| 817,094 | 4/1906 | Ryan | 285/154 |
| 1,661,202 | 3/1928 | Thayer . | |
| 2,312,659 | 3/1943 | Luff . | |
| 3,086,543 | 4/1963 | McAuley | 137/216 |
| 3,374,726 | 3/1968 | Takayanagi . | |

*Primary Examiner*—Gerald A. Michalsky

[57] ABSTRACT

The object of the invention is to provide a tubular fitting for connection to an overflow pipe on a sanitary silo in order to introduce sanitary air into any siphonal discharge therefrom and thereby reduce vacuum in the silo to prevent its collapse by implosion. The fitting (5) is generally tubularly Y-shaped with branch passageways (13) and (14) connecting an upper portion of an overflow pipe (3) with a sanitary air intake pipe (12), said branch passageways extending downwardly into an enlarged confluence region (15) which terminates in a single downwardly tapered passageway (16) for connection to a lower portion of said overflow pipe (3). The other object is to provide a sanitary air intake pipe (12) extending upwardly from an enclosed sanitary structure (4) into the fitting (5) thereby preventing unclean matter from entering the silo (1) during normal operation or when the silo is overfilled.

2 Claims, 2 Drawing Sheets

VACUUM RELIEF FITTING FOR SANITARY SILOS

TECHNICAL FIELD

This invention deals broadly with the subject of food processing where liquid or solid food particles (which behave as fluids) need to be stored in sealed sanitary vertical towers commonly called sanitary silos.

More particularly, the present invention relates to a siphon venting or vacuum breaking device to prevent the collapse of a silo's dome when a sanitary silo is overfilled and then is rapidly drained by an overflow pipe causing a vacuum therein.

Even more specifically, this new invention pertains to a branched tubular fitting with a confluence region between a passageway for the effluent discharge from a silo and a single sanitary air intake pipe for introduction of sanitary air into the suctional discharge in the overflow pipe thereby reducing the vacuum in the silo's dome while preserving the sanitary environment in the silo.

The present invention has no moving parts nor valves and utilizes only the basic principles of fluid mechanics and the art of plumbing for its operation.

BACKGROUND ART

Silos used in processing foods for human consumption are usually thought of as enclosed cylindrical towers for preventing air and moisture from passing in or out of the food stored therein, and in sanitary silos, which are commonly filled from their bottoms, there is often a problem of overfilling the silos causing their rupture.

In an attempt to remedy this problem, an overflow pipe is often installed vertically between the dome of the silo and a sanitary enclosure at the silo's base thereby providing a passageway for discharging the overfilled portion of the silo's content while preserving the silo's sanitary environment by preventing unclean matter from entering the silo through the outlet end of the overflow pipe.

However, because sanitary silos and their vertical overflow pipes often extend nearly 80 feet high, the internal forces exerted by several hundred tons of fluids contained therein are extremely great, especially when the silo is overfilled and the overfilled portion of the fluid enters the inlet end of the overflow pipe and begins its long decent down said pipe to its outlet end thereby initiating the siphonal discharge of the overfilled portion in the silo.

Although the principle of a siphon is well known, it shall briefly be repeated here as it relates to the present problem with sanitary silos.

It has long been known that the surfaces of two fluids will always attempt to attain the same level provided that there is a common connection between them. If, for example, the surface of one fluid is higher than another, a siphonal discharge of the higher fluid to the lower may be accomplished through a tubular conduit called a siphon. Because the pressure of the fluid at the higher end of the siphon tube is greater than the pressure at the lower end of the siphon tube, fluid will be pulled down the siphon tube by gravity until the pressure at both ends of the siphon tube are equal as demonstrated when the surfaces of both fluid levels are at the same height and therefore both sides of the siphon tube contain the same weight of fluid causing the siphon to stop.

In sanitary silos, however, there is usually only one essentially vertical overflow pipe with its inlet end entering the silo a few feet below the silo's dome which allows a headspace of sanitary atmospheric pressure above food normally stored therein. But when the silo is overfilled the atmosphere in the headspace is quickly replaced with fluid until the overflow pipe can remove it. Once the overflow pipe is full of effluent discharge from the dome there is established the required common connection between the greater pressure at the inlet end and lesser pressure at the outlet end resulting in a downward suctional acceleration of the overfilled portion thereby causing a vacuum in the head-space of the silo's dome.

One logical solution to the problem of suctional discharge in the overflow pipe would appear to be installation of some sort of siphon venting or vacuum breaking device on either the overflow pipe or in the silo's dome, however all such known devices do not address the requirement for sanitation as established by such organizations as the United States Department of Agriculture which require that air vents shall be designed to protect against entrance of foreign material into the silo.

For example, there are known in the prior art numerous siphon venting and vacuum breaking devices generally found in the United States Patent Classification, Class 137, Fluid Handling. Such mechanical devices, like those found in Sub-class 143, are responsive to-and are activated by pressure differences in an enclosed container such as a tank, pipe or conduit but these devices require some mechanical component inside the container in direct or proximal contact with the fluid therein or expose the fluid food supply to the open atmosphere causing contamination.

Accordingly, it is the general object of the present invention to provide an external means with no moving parts which automatically provides sanitary air by suction into a siphonal discharge from an overfilled sanitary silo thereby offsetting and relieving vacuum in the silo's dome to prevent its collapse by implosion.

DISCLOSURE OF INVENTION

In accordance with the present invention, we provide a branched tubular fitting for connection to and joining with an overflow pipe on a sealed sanitary silo for automatically offsetting and regulating the suction therein caused by a siphonal discharge from overfilling the silo.

Our invention necessarily embodies and is connected to and is joined with a vertical sanitary air intake pipe which is essentially of the same height and extends vertically parallel as the overflow pipe with their outlet and inlet ends enclosed in a sanitary environment such as a chamber for not only receiving the effluent discharge from the silo, but also providing sanitary air to the intake pipe while preventing unclean matter from entering the silo in accordance with guidelines established by several authorities for the design and fabrication of sanitary silos as promulgated by such organizations as the International Association of Milk, Food and Environmental Sanitarians, Inc., Dept. B, P.O. Box 701, Ames, Iowa 50010, U.S.A., Telephone: 515-232-6699, Ext. B.

The branched tubular fitting of our present invention comprises a generally Y-shaped housing defining upwardly positioned branch passageways for connection to an upper portion of an overflow pipe and a sanitary air intake pipe, said passageways joining at a junctional confluence region in the proximal center of the fitting which extends downwardly to a common outlet opening for connection to the lower portion of the overflow pipe thereby providing the means for introducing sanitary air by suction produced at the confluence region due to the siphonal discharge through the fitting into the overflow pipe thus reducing vacuum in the dome of the silo.

BRIEF DESCRIPTION OF DRAWINGS

The details of our invention will be described in connection with the accompanying drawings, in which

FIG. 1 illustrates such a silo filled to its capacity by fluid food (solid dots) with overflow pipe to admit sanitary air (circles) to the headspace in the dome.

FIG. 2 illustrates an overfilled silo being drained by the overflow pipe.

FIG. 3 illustrates the implosion of the silo's dome caused by suctional discharge.

BEST MODE FOR CARRYING OUT THE INVENTION

Figure 1:
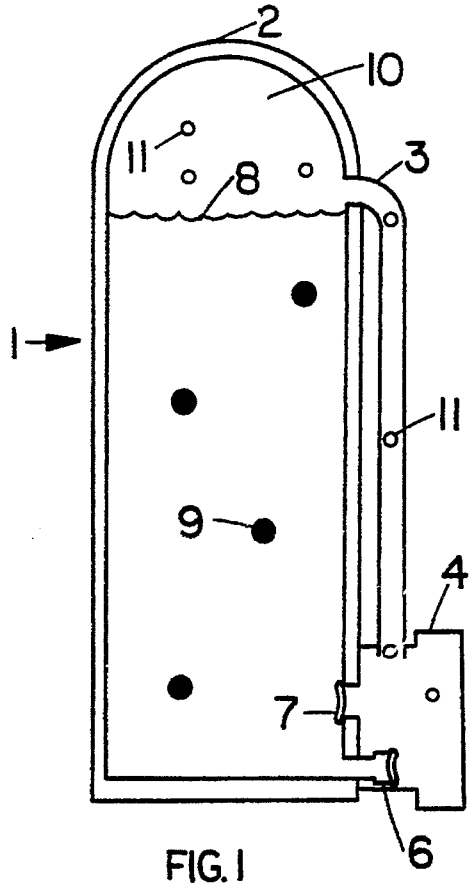
FIGS. 1–3 are simplified cross-sectional views of presently known sanitary silos which illustrate the present problem caused by overfilling them.

Referring to the drawings, the reference numeral 1 generally refers to a sanitary silo of the type commonly used for storage of fluid foods. A convex dome 2 encloses the top of the silo I below which an overflow pipe 3 extends downwardly into an enclosed sanitary structure 4. The sanitary structure is often a room for operating the silo 1 and usually contains a port 6 for filling and emptying the silo, access means 7, and other controls for cleaning the silo which have been omitted from the drawings since they are not relevant to the present invention.

Figure 2:
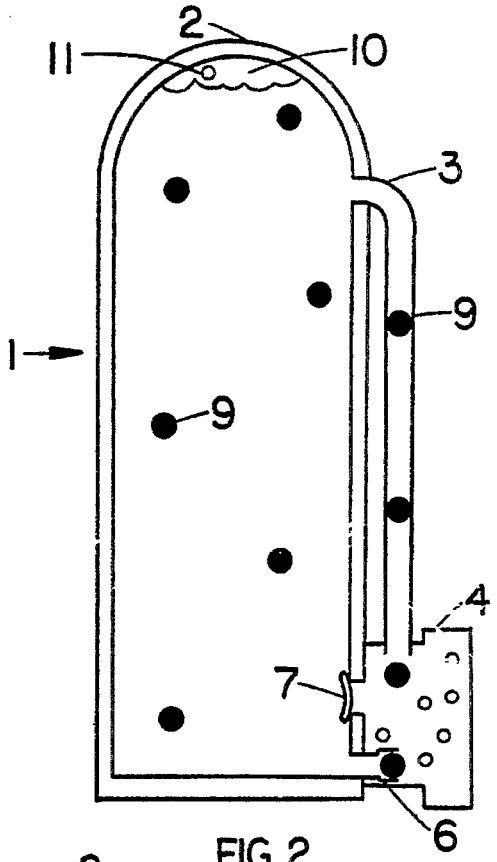

As illustrated in FIG. 1, the silo 1 is filled to its proper maximum level 8 with fluid food 9 (indicated by dots) above which there is a headspace 10 filled with sanitary atmospheric pressure 11 (indicated by circles). It can be easily seen that one function of the overflow pipe 3 is to provide an exit means for trapped sanitary air in the silo 1 as it is filled with fluid but very often the silo is inadvertently overfilled as illustrated in FIG. 2 because the velocity of the fluid entering the silo through the port 6 is under pressure and is greater than the velocity of the over-filled portion being drained by the overflow pipe 3 which results in the fluid rising into the headspace 10 of the silo.

Figure 3:
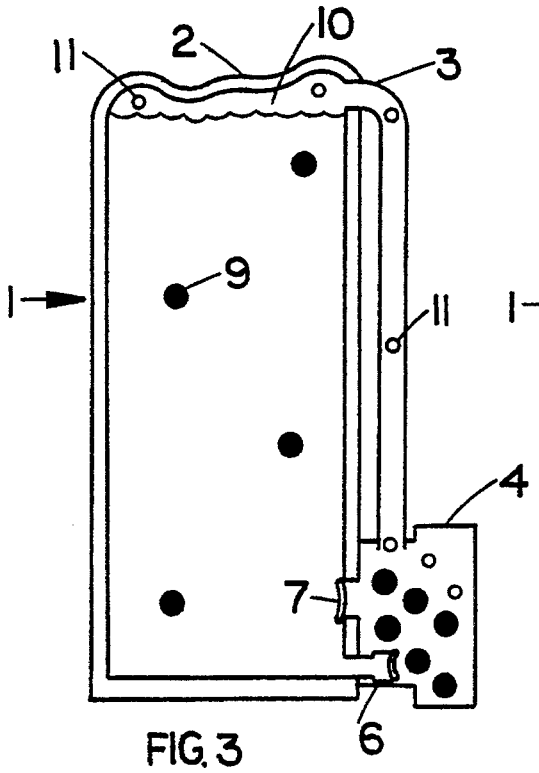

The usual result of an overfilled sanitary silo is illustrated in FIG. 3. As the overflow pipe 3 becomes filled with fluid 9 (see FIG. 2), there is established a siphonal discharge from the headspace 10 causing a vacuum therein and often resulting in the collapse of the dome 2.

Figure 4:
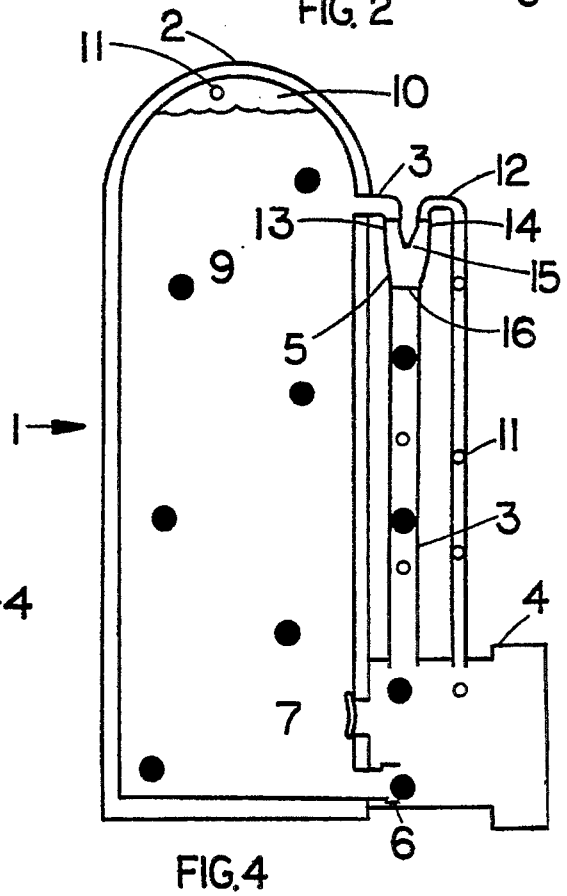
FIG. 4 is another cross-sectional view of the sanitary silos shown in FIG'S. 1–3, but with the branched tubular fitting and sanitary air intake pipe of this invention installed.

The installation and operation of our present invention to remedy this problem is illustrated in FIG. 4. Here it is observed that a portion of the overflow pipe 3 has been cut away and replaced by our branched tubular fitting 5 which is also connected to a sanitary air intake pipe 12 with its inlet end enclosed in the sanitary structure 4. This particular arrangement, which is claimed as part of our invention, allows only sanitary air 11 to enter the silo 1 during its normal operation (see FIG. 1) and, moreover, our invention allows only sanitary air 11 to be drawn into any suctional discharge when the silo 1 is overfilled.

Figure 5:
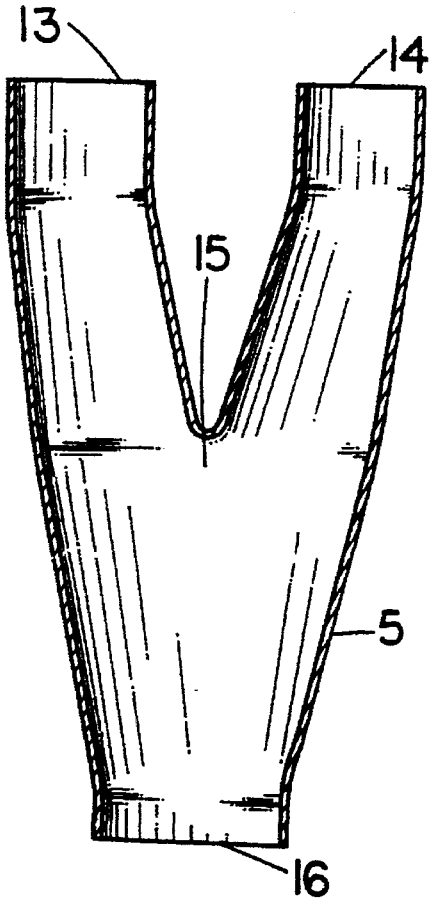
FIG. 5 is an enlarged cross-sectional view of the branched tubular fitting as seen disconnected from the silo.

FIG. 5 is an enlarged cross-sectional view of our branched tubular fitting 5 of the present invention. It is preferably fabricated from stainless steel so that it may be welded onto any existing overflow pipe of the same material, however it is also possible to fabricate our invention from other materials and install it by other means provided that these meet guidelines and criteria of the organizations heretofore mentioned.

Our fitting 5 is generally tubularly Y-shaped with upwardly positioned first and second branch passageways of essentially equal length. The first branch passageway 13 has a larger diameter for connection to an upper portion of an overflow pipe 3, while the second branch passageway 14 has a generally smaller diameter for attachment to a sanitary air intake pipe 12, both first and second branch passageways joining in an enlarged essentially circular confluence region 15 at the proximal center of our fitting 5 and extending downwardly into a common tubular passageway 16 of appropriate diameter for attachment to and connection with the lower portion of the overflow pipe 3.

Figure 6:
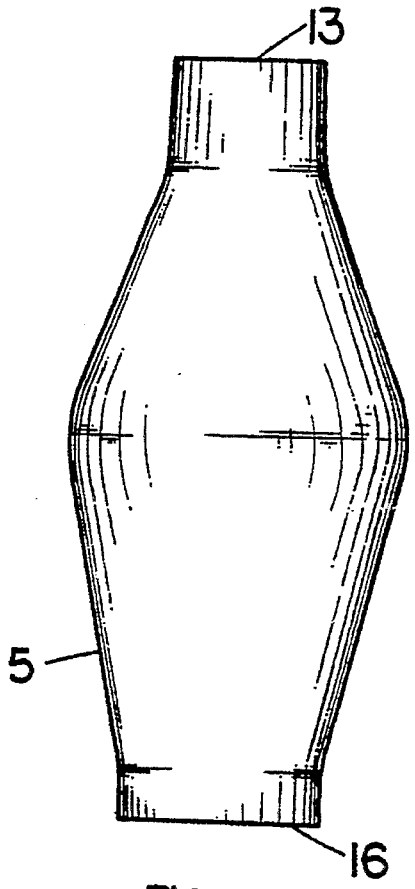
FIG. 6 is a side elevational view.

FIG. 6 is a side elevational view of the fitting 5 illustrating the shape of the enlarged confluence region 15 in relation to the diameter of the first branch passageway 13 and common tubular passageway 16.

Figure 7:
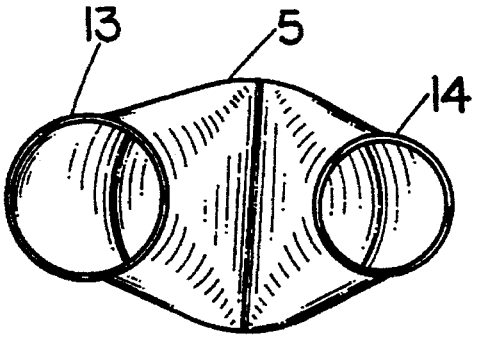
FIG. 7 is a top plan view.
Figure 8:
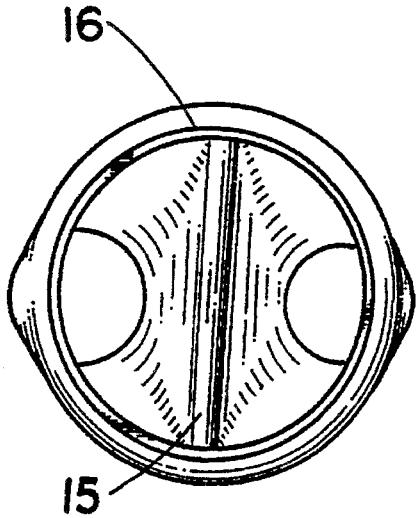
FIG. 8 is a bottom plan view thereof.

FIG. 7 shows the relative diameters of the first 13 and second branch passageways in a top plan view, while FIG. 8 illustrates the shape of the internal confluence region 15 as seen through the common passageway 16 in a bottom plan view.

Having described our invention in detail, we claim:

1. A sanitary silo comprising: a tank for storage of fluids; an overflow pipe exiting the tank at a predetermined site; a sanitary air intake pipe extending from an enclosed sanitary structure; a generally Y-shaped branched fitting with first and second branch passageways, the first branch passageway being connected to the overflow pipe and the second branch passageway being connected to the sanitary air intake pipe, both said branch passageways in fluid communication with a confluence region in the fitting, the fitting having a single passageway for permitting fluid communication between the confluence region and an enclosed sanitary enclosure.

2. An improved sanitary silo of the type for storage of fluid foods and of the type which allows a headspace of sanitary atmospheric pressure above food normally stored therein and provides an overflow pipe in fluid communication with the tank at a predetermined level, wherein the improvement comprises: a generally Y-shaped branched fitting which connects the overflow pipe with a sanitary air intake pipe extending from an enclosed sanitary structure, said improvement thereby preventing unclean matter from entering the silo under normal use but also providing sanitary air to reduce any suctional discharge in the overflow pipe thereby reducing vacuum in the silo when it is overfilled and drained by said overflow pipe.

* * * * *